United States Patent [19]

Stanley

[11] 4,215,293

[45] Jul. 29, 1980

[54] CADENCE SCANNED FLAT IMAGE DISPLAY DEVICE

[75] Inventor: Thomas O. Stanley, Princeton, N.J.

[73] Assignee: RCA Corporation, New York, N.Y.

[21] Appl. No.: 783,655

[22] Filed: Apr. 1, 1977

[51] Int. Cl.[2] ..... H01J 29/70; H01J 29/72

[52] U.S. Cl. ..... 315/366; 313/422

[58] Field of Search ..... 315/366, 400, 422

[56] References Cited

U.S. PATENT DOCUMENTS

| | | | |
|---|---|---|---|
| 2,850,669 | 9/1958 | Geer | 315/366 X |
| 2,899,597 | 8/1959 | Kompfner | 315/382 X |
| 4,031,427 | 6/1977 | Stanley | 315/366 X |
| 4,069,439 | 1/1978 | Anderson | 315/366 X |
| 4,103,204 | 7/1978 | Credelle | 315/366 X |

*Primary Examiner*—Theodore M. Blum

*Attorney, Agent, or Firm*—E. M. Whitacre; G. H. Bruestle; L. L. Hallacher

[57] ABSTRACT

An image display device includes a flat evacuated envelope which has a front and a back wall. On the inner surface of the front wall is a phosphor screen for displaying the image. A first set of electron beam guides is between the back wall and the screen. A second set of electron beam guides is at one end of the first set of beam guides. A source of electrons is postioned to inject an electron beam into the second set of guides. A deflection means is provided to direct the electron beam from the second set of guides into the first set of guides.

8 Claims, 3 Drawing Figures

CADENCE SCANNED FLAT IMAGE DISPLAY DEVICE

BACKGROUND OF THE INVENTION

The present invention relates to cathodoluminescent flat image display devices.

Recently flat image display devices have been suggested having a viewing screen of about 75×100 cm. and a total depth of about 2.5 to 10.0 cm. One such device is described in U.S. patent application No. 607,492 now U.S. Pat. No. 4,031,427 entitled "Flat Electron Beam Addressed Device" filed on Aug. 25, 1975 by T. O. Stanley. This type of device utilizes a plurality of electron beams which excite different portions of a large phosphor screen. A plurality of electron beam guides extend between the front and rear surfaces of the device to direct the electron beams to the proper area of the screen.

If such devices are to be utilized for the display of television information, a high degree of brightness uniformity must exist across the entire viewing surface. This high degree of brightness uniformity is difficult to achieve in devices employing a plurality of electron beams to scan different portions of the display. Since the electron current of each beam may not be equal, the various portions of the phosphor screen may not be excited equally.

This problem of non-uniformity has not existed in conventional cathode ray tubes since a single electron beam scans all of the picture elements or in the case of a color tube all of the picture elements of one color. Therefore, each picture element receives a controlled amount of excitation energy. However, in large area flat cathodoluminescent display devices, the internal support necessary to prevent the collapse of the evacuated envelope under atmospheric pressure makes it difficult to conventionally scan the entire viewing surface with a single beam.

SUMMARY OF THE INVENTION

A flat image display device utilizes an evacuated envelope with a front wall, having a screen on its inner surface composed of cathodoluminescent elements, and a back wall spaced from the front wall. A first set of electron beam guides extend between the back wall and the screen. A second set of electron beam guides is at one end of the first set of beam guides. A source of electrons is positioned to inject several electron beams into the second set of beam guides. The device also includes means for deflecting the electron beams from the second set of beam guides into the first set of beam guides. During the operation of the display, the electron beams generated by the source travel down the second set of guides and are sequentially deflected into a plurality of the guides in the first set. The electron beams travel through one of the first sets of guides until they are deflected onto the screen at the proper point where they excite the cathodoluminescent elements.

DETAILED DESCRIPTION OF THE PREFERRED EMBODIMENT

Figure 1:
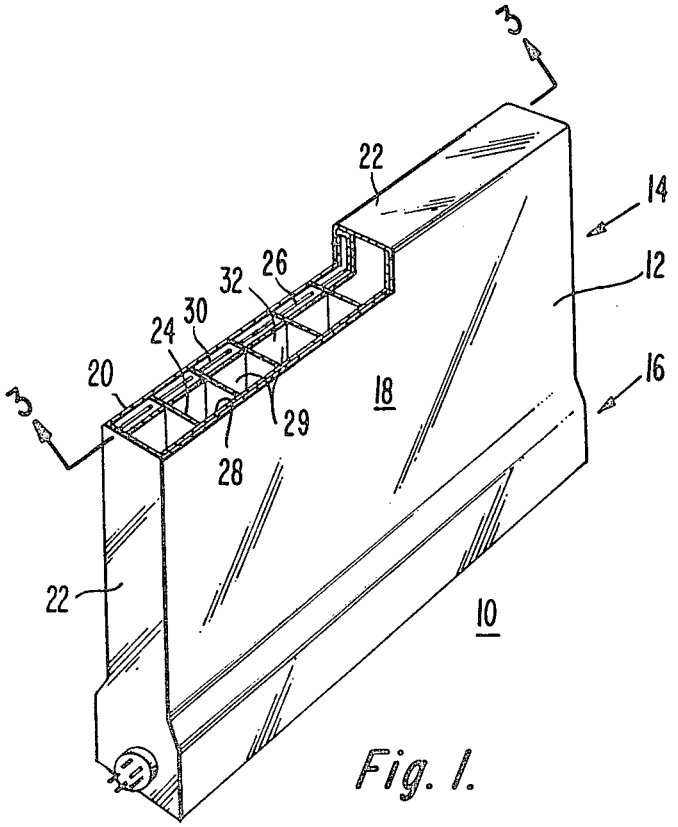
FIG. 1 is a cut-away perspective view of a flat image display device incorporating the present invention.

Referring to FIG. 1, one form of a flat display of the present invention is generally designated as 10. The display device 10 comprises an evacuated envelope 12 typically of glass, having a display section 14 and an electron gun section 16. The display envelope 12 includes a rectangular front wall 18 and a rectangular back wall 20 in a spaced parallel relation with the front wall 18. The front wall 18 and the back wall 20 are connected by sidewalls 22.

A plurality of spaced, parallel support walls 24 are secured between the front wall 18 and the back wall 20 and extend from the gun section 16 to the opposite sidewall 22. The support walls 24 provide the desired internal support against external atmospheric pressure and divide the display section 14 into a plurality of channels 29. The channels 29 extend in the vertical dimension when the device 10 is oriented as shown in the Drawing. On the inner surface of the front wall 18 is a screen 28 composed of cathodoluminescent elements which may be of any well known type presently used in cathode ray tubes. In a color display for example, the phosphor screen in each of the channels 29 alternate between red, green and blue light emitting phosphor stripes or elements.

Figure 2:
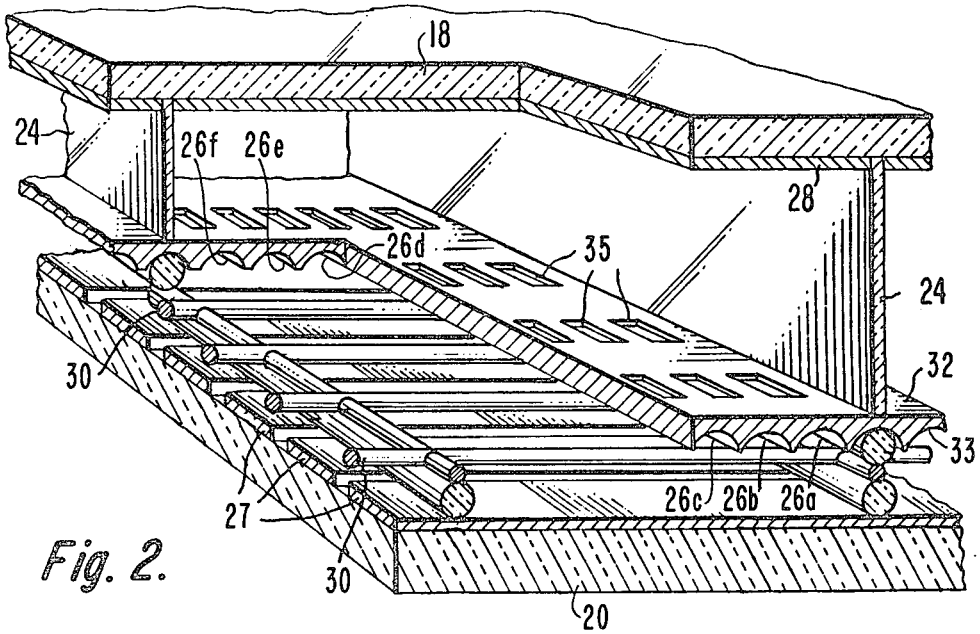
FIG. 2 is a transverse sectional view looking down on the cut-away portion of FIG. 1.

As shown in FIG. 2, six vertical electron beam guides 26*a–f* are disposed in each channel 29. Each beam guide may utilize the technique of slalom focusing which is described in the article entitled, "Slalom Focusing," by J. S. Cook et al, *Proceedings of the IRE,* Vol. 45, November 1957, pages 1517–1522. Slalom focusing, as there described, makes use of an electron guide formed by a plurality of spaced, parallel wires or rods arranged in a common plane midway between two parallel plates. The wires or rods are charged positively with respect to the plates. The electrostatic field thereby created is such that when a beam of electrons is directed into the space between the plates along the plane of the rods or wires, the beam will weave in an undulating path through the array of rods or wires. While such a structure adequately provides for confining the beam along its intended path, it does not provide for extraction of the beam from the structure at selected points as is required in the present invention. Other beam guides may also be employed with this novel scanning concept.

Figure 3:
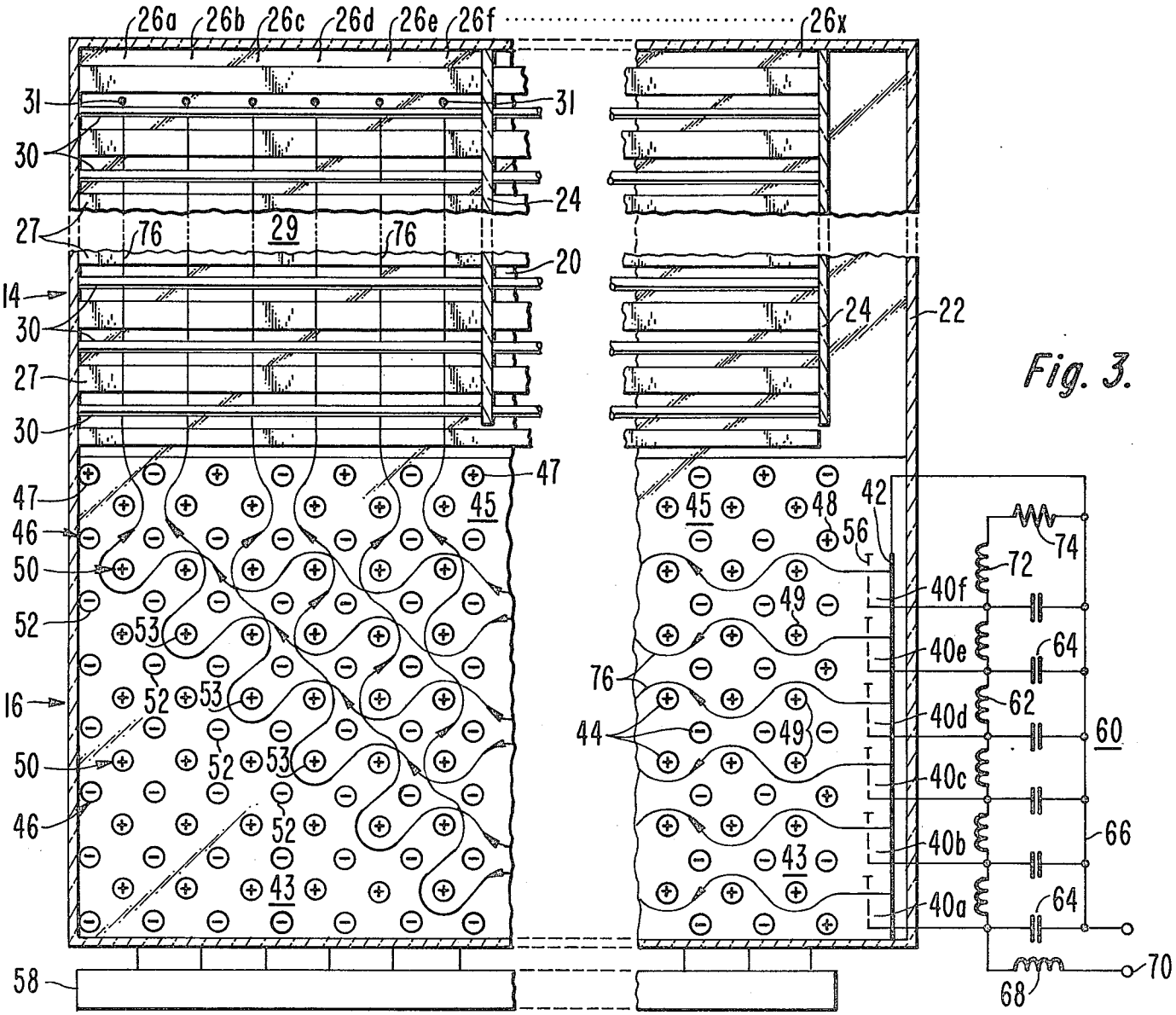
FIG. 3 is a sectional view along line 3—3 of FIG. 1 with a partial schematic of the electronic circuitry.

The vertical beam guides 26*a–f* comprise a plurality of electrode stripes 27 extending transversely across all the channels 29 on the back wall 20. A toggle electrode stripe 33 extends across the end of all the channels 29 between the display section 14 and the gun section 16 (FIG. 3). Spaced from and substantially parallel to the back wall 20 are a plurality of conductors 30 such as wires, extending in a plane parallel to the screen across all the channels 29. Between the conductors 30 and the front wall 18 is a metal ground plate 32 which extends transversely across all of the channels 29 substantially parallel to the back wall 20. On the rear surface of the ground plate 32 are a plurality of grooves 33 extending the length of the plate 32. Each groove defines a vertical beam guide 26*a–f* within the channel 29. A plurality of apertures 35 extend through the plate 32 within each groove 33. The vertical beam guide structure is described in U.S. Patent Application Ser. No. 607,490, now U.S. Pat. No. 4,103,204 entitled "Flat Display Device With Beam Guide" filed on Aug. 25, 1975 by Thomas Credelle.

The conductors 30 are maintained at a positive potential and the electrode stripes 27 and ground plate 32 are maintained at ground or a negative potential. This biasing of the stripes 27 and plate 32 forms a ground potential plane on each side of the conductors 30 which confines an electron beam as it oscilates above and below the conductors 30 in a path through the guide. The electrode stripes 27 can be switched to a more negative potential which deflects the electron beam out of the vertical beam guide through the apertures 35 and toward the screen 28.

The gun section 16 is an extension of the display section 14 and extends along one set of adjacent ends of channels 29 as shown in FIG. 3. At one end of the gun section are six electron guns 40*a–f* utilizing a single line cathode 42. Each electron gun is associated with a different horizontal slalom guide 43 and injects an electron beam 76 into the guide. A transition horizontal guide 45 is between the other horizontal guides 43 and the display section 14 and does not have an electron gun associated with it. The horizontal guides comprise a plurality of electrodes 44 extending between the front and back walls 18 and 20 in the gun section. The electrodes 44 are arranged in two alternating sets of substantially parallel staggered rows 46 and 50. The first set of alternate rows 46 form a ground plane for the slalom guide on each side of the row. The second set of alternate rows 50 is positively biased so that the electron beams 76 will oscillate above and below the electrodes 44 in the row 50. The electrodes 48 in the first rows 46 which are closest to the electron guns 40 are toggle electrodes for directing the electron beam 76 above or below the first electrode 49 and the second rows 50. The first row of electrodes in the transition guide 45 which is closest to the display section comprise transition toggle electrodes 47 for aligning the beams with the vertical guides. The electrical potentials applied to the toggle electrodes 47 and 48 and the other electrodes in the second gun 50 are generated and controlled by switching circuit 58.

A delay line driving circuit 60 is connected to each of the six electron guns 40*a–40f*. Each electron gun has a grid 56 for modulating the generated electron beam. An inductor 62 is connected between the grids 56 of adjacent guns 40. A capacitor 64 is connected between each grid and the cathode via line 66. Another inductor 68 is connected between video input terminal 70 and the grid of the first electron gun 40*a*. Another inductor 72 and a series load resistor 74 are between the grid of the sixth electron gun 40 and the cathode. The combination of the inductors 62, 68 and 72; capacitors 64; and the load resistor 74 form a delay line circuit for delaying the video signal on line 70 to the various grids of the electron guns 40*a–40f*.

During the operation of the device, each of the electron guns 40*a–f* emits an electron beam 76 which travels through each horizontal beam guide 43. Each beam 76 is confined to the horizontal guide by the ground plane formed by a negative potential on the electrodes 44 in the first rows 46. The electron beam 76 travels through each horizontal guide 43 weaving above and below the positively biased electrodes 44 in one of the second rows 50. The concept of utilizing positively and negatively biased electrodes as a beam guide is described generally in U.S. Pat. No. 2,899,597 entitled "Apparatus Utilizing Slalom Focusing" issued on Aug. 11, 1959 to R. Kompfner.

When the beam 76 in a guide is to be deflected into one of the vertical guides 26 in a channel 29, the next electrode 52 in the first row 46 of the beam guide which is more remote from the vertical guide is switched to a more negative potential repelling the electron beam 76 so that the beam 76 curls around the previous positively biased electrode 53 in the second row 50. The beam 76 then takes a weaving path, at right angles to the previous path, toward one of the channels 29. The beam 76 continues in vertical direction to weave around the positively biased electrodes, confined horizontally by the negatively biased electrodes. As the vertically travelling beams pass through the transition guide 45, the transition toggle electrodes 47 are biased to straighten the beam out and align it with one of the vertical beam guides 26. Once the beam 76 reaches the channel 29, it begins to weave above and below the conductors 30 in the vertical beam guide 26. The potential applied to the toggle electrode stripe 53 determines whether the beam goes above or below the first conductor 30. The beam continues in the vertical beam guide 26 until it is deflected at a point designated 31 in FIG. 3, through the apertures 35 in the ground plate 32 toward the phosphor screen 28. The deflection is accomplished by negatively biasing one of the electrode stripes 27 on the back wall 20 to repell the beam. When the beam strikes the screen, a cathodoluminescent element is excited thereby emitting light. By switching the potential on the electrodes in the first rows, the beams can be directed into various vertical guides and toward different points on the screen.

During the display of an image, each electron beam scans the entire screen a line at a time as in conventional television displays. The selection of the line to be scanned is made by negatively biasing one of the electrode stripes 27 in all of the vertical guides. The line is scanned by sequentially deflecting each electron beam 76 from its horizontal beam guide 42 into the vertical guides so that each beam gets deflected into every vertical guide. The negatively biased electrode stripe 27 deflects the beams out of the guides to form a line of the image on the screen 28.

Before the line scan begins a horizontal blanking signal is applied to turn off the guns 40*a–f*. As the line scan begins, the video information for modulating the beam is fed to the first electron gun 40*a* via line 70. At this point in time, the delay circuit 60 applies the horizontal blanking signal which preceded the video information to the remaining electron guns 40*b–40e*. Therefore, only the first gun 40*a* emits an electron beam 76. The generated beam 76 travels through the corresponding horizontal guide 43 and is deflected into the first vertical guide, 26*a*. The beam 76 continues to travel along the vertical beam guide 26*a* in the first channel 29 until it is deflected toward the screen 28 at point 31. The beam strikes the screen exciting the phosphor to display a picture element.

After the picture element in the first guide 26*a* has been displayed, the video information for the picture element in the second vertical guide 26*b* is fed on line 70 to the first gun 40*a*. The electron beam 76 from the first gun 40*a* then is deflected into the second vertical guide 26*b* by switching the potential on the next electrode 52 in the lower first row 46. At the same time, the video signal for the picture element in the first vertical guide 26*a* has been delayed by the delay circuit 60 and is being fed to the second electron gun 40*b*, while the blanking signal is applied to the remaining guns. The beam from the second gun 40*b* is directed into the first vertical guide 26*a*. The video signal is delayed in time to coincide with the spacial delay of each beam 76. One by one each of the guns 40 is turned on and the electron beams are shifted into each vertical guide 26 until all the guns are on as shown in FIG. 3. When the potentials on the electrodes in the second set of rows 50 are switched to change the beam deflection it may be necessary to blank the guns 40 to prevent spurious electron deflection.

The line scanning continues by sequentially deflecting the six beams 76 into each of the vertical guides 26 proceeding from the sixth vertical guide 26*f* to the last one 26X. After the beam from the first gun 40*a* has been deflected into the last vertical guide 26*x*, a horizontal blanking signal turns off the first gun 40*a*. The other electron guns 40*b*–40*e* are turned off in sequence by the horizontal blanking signal after their respective beams are deflected into the last vertical guide 26*x*. When all the guns have been turned off, a new line is selected by choosing a new point 31 at which to deflect the beams out of the vertical beam guides 26 toward the screen. After this selection, the line scan begins again by directing the beam 76 from the first gun 40*a* into the first vertical guide 26*a*. Thus, the horizontal scanning of the display is accomplished by deflecting the beams into the vertical guides while the deflection of the beam toward the screen at various points along the vertical guides accomplishes the vertical scanning.

Although the paths of the electron beams 76 cross at various points 80 in the gun control section 16, the probability of the electrons colliding with each other is extremely small because of the relatively low electron density of the beams. In addition, the relatively weak electromagnetic fields within the guides do not appreciably interfere with the beams.

In the present display device, each of a plurality of relatively low energy electron beams scan the entire display. Since each beam scans each picture element, the problem of brightness nonuniformity due to unequal electron beam currents has been eliminated.

I claim:

1. An image display device comprising an evacuated envelope having a front and a back wall;

a screen comprising a plurality of cathodoluminescent elements on the inner surface of the front wall;

a set of first electron beam guides between the back wall and the screen for guiding an electron beam in a given path, each first guide including means for deflecting the electron beam toward the screen to excite a cathodoluminescent element;

a set of second electron beam guides at the end of the first set of beam guides and angularily disposed with respect to said first set of beam guides for guiding an electron beam in a given path;

a source of electrons for injecting a plurality of electron beams into the second set of guides; and means for directing the electron beams from the second guides into the first guides so as to excite each cathodoluminescent element with a plurality of beams.

2. The device as in claim 1 wherein the first beam guide comprises a plurality of first slalom focusing guides.

3. The device as in claim 2 wherein the first electron beam guides comprise:

a plurality of electrode stripes on the back wall extending transverse to the path of the electron beam for deflecting said electron beam toward said screen;

a plurality of first conductors extending transverse to the path of the electron beam, spaced from and substantially parallel to the back wall; and means for establishing a ground plane substantially parallel to the back wall between the first conductors and the screen while enabling electrons to flow from between the conductors and the back wall to the screen.

4. The device as in claim 3 wherein the means for establishing a ground plane comprises a metal plate having a plurality of apertures therethrough.

5. The device as in claim 1 wherein the second beam guides comprise a plurality of second slalom electron beam guides.

6. The device as in claim 5 wherein the second slalom beam guides comprise a plurality of electrodes extending between the front and back walls and arranged in two alternating sets of substantially parallel staggered rows, one set of rows forming the ground planes between which is a separate beam guide.

7. The device as in claim 6 including toggle electrodes at the point of the injecting of the electron beams into the second beam guides.

8. The device as in claim 6 wherein the means for directing the electron beam comprises a switching circuit for controlling the bias voltage on the electrodes in the other set of rows.

* * * * *